US010323476B2

(12) United States Patent
Murphree et al.

(10) Patent No.: US 10,323,476 B2
(45) Date of Patent: Jun. 18, 2019

(54) INTERNALLY TRUSSED HIGH-EXPANSION SUPPORT FOR INFLOW CONTROL DEVICE SEALING APPLICATIONS

(71) Applicant: Halliburton Energy Services, Inc., Houston, TX (US)

(72) Inventors: Zachary Ryan Murphree, Dallas, TX (US); Michael Linley Fripp, Carrollton, TX (US); John Gano, Lowry Crossing, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 208 days.

(21) Appl. No.: 15/512,690

(22) PCT Filed: Nov. 12, 2014

(86) PCT No.: PCT/US2014/065218
§ 371 (c)(1),
(2) Date: Mar. 20, 2017

(87) PCT Pub. No.: WO2016/076853
PCT Pub. Date: May 19, 2016

(65) Prior Publication Data

US 2017/0292341 A1 Oct. 12, 2017

(51) Int. Cl.
*E21B 43/12* (2006.01)
*E21B 33/127* (2006.01)
(Continued)

(52) U.S. Cl.
CPC ..... *E21B 33/1208* (2013.01); *E21B 17/00* (2013.01); *E21B 33/12* (2013.01);
(Continued)

(58) Field of Classification Search
CPC ..... E21B 33/1277; E21B 43/12; E21B 34/06; E21B 43/108
See application file for complete search history.

(56) References Cited

U.S. PATENT DOCUMENTS 3,477,506 A * 11/1969 Malone ..... E21B 23/00 166/187
6,315,040 B1 * 11/2001 Donnelly ..... E21B 43/084 166/207

(Continued)

OTHER PUBLICATIONS

International Search Report and Written Opinion issued in related PCT Application No. PCT/US2014/065218 dated Jul. 28, 2015, 14 pages.

(Continued)

*Primary Examiner* — Shane Bomar
(74) *Attorney, Agent, or Firm* — Scott Richardson; Baker Botts L.L.P.

(57) ABSTRACT

A downhole system and method is disclosed for sealing an inflow control device installed in a subterranean formation along a length of production tubing adjacent a productive zone of the subterranean formation. The system includes a truss structure radially expandable between a contracted configuration and an expanded configuration and a sealing structure disposed radially external to the truss structure. The truss structure and the sealing structure are set in their expanded configurations so that the sealing structure is put into engagement with the inflow control device so as to restrict the flow of fluids from the subterranean formation into the production tubing at the location of the inflow control device.

20 Claims, 6 Drawing Sheets

(51) Int. Cl.

| | |
|---|---|
| ***E21B 33/12*** | (2006.01) |
| ***E21B 34/06*** | (2006.01) |
| ***E21B 43/10*** | (2006.01) |
| ***E21B 43/14*** | (2006.01) |
| ***E21B 17/00*** | (2006.01) |
| ***E21B 47/09*** | (2012.01) |

(52) U.S. Cl.

CPC ..... *E21B 33/127* (2013.01); *E21B 34/06* (2013.01); *E21B 43/108* (2013.01); *E21B 43/12* (2013.01); *E21B 43/14* (2013.01); *E21B 47/09* (2013.01)

(56) References Cited

U.S. PATENT DOCUMENTS 6,478,092 B2 * 11/2002 Voll ..... B01D 29/111 166/378
6,695,054 B2 2/2004 Johnson et al.
9,982,507 B2 * 5/2018 Murphree ..... E21B 43/26
2002/0046840 A1 4/2002 Schetky et al.
2002/0107562 A1 8/2002 Hart et al.
2003/0079886 A1 5/2003 Schetky et al.
2003/0089496 A1 5/2003 Price-Smith et al.
2004/0020660 A1 2/2004 Johnson et al.
2004/0026079 A1 2/2004 Johnson et al.
2004/0074642 A1 4/2004 Price-Smith et al.
2004/0084176 A1 5/2004 Hackworth et al.
2004/0089454 A1 5/2004 Hackworth et al.
2005/0016740 A1 * 1/2005 Aldaz ..... E21B 33/1246 166/387
2005/0098324 A1 * 5/2005 Gano ..... E21B 34/06 166/384
2005/0155773 A1 * 7/2005 Wetzel ..... E21B 43/105 166/381
2007/0084277 A1 * 4/2007 Steinsiek ..... E21B 47/101 73/152.18
2008/0149349 A1 6/2008 Hiron et al.
2009/0065199 A1 * 3/2009 Patel ..... E21B 23/03 166/250.01
2010/0175895 A1 * 7/2010 Metcalfe ..... E21B 33/1277 166/382
2010/0319928 A1 * 12/2010 Bussear ..... E21B 34/06 166/373
2011/0114336 A1 * 5/2011 Lehr ..... E21B 43/103 166/380
2011/0122727 A1 * 5/2011 Gleitman ..... E21B 36/02 367/81
2011/0147007 A1 6/2011 O'Malley et al.
2011/0214855 A1 9/2011 Hart et al.
2012/0278053 A1 * 11/2012 Garcia ..... E21B 43/00 703/10
2013/0220640 A1 8/2013 Fripp et al.
2013/0220641 A1 8/2013 Fripp et al.
2013/0220642 A1 8/2013 Fripp et al.
2013/0220643 A1 8/2013 Fripp et al.
2013/0220644 A1 8/2013 Fripp et al.
2014/0151054 A1 6/2014 Norrid
2015/0144330 A1 * 5/2015 Noblett ..... E21B 33/1277 166/244.1
2015/0167424 A1 * 6/2015 Richards ..... E21B 33/134 166/386
2018/0155991 A1 * 6/2018 Arsalan ..... E21B 33/146

OTHER PUBLICATIONS

International Preliminary Report on Patentability issued in related Application No. PCT/US2014/065218, dated May 26, 2017 (11 pages).

* cited by examiner

INTERNALLY TRUSSED HIGH-EXPANSION SUPPORT FOR INFLOW CONTROL DEVICE SEALING APPLICATIONS

CROSS-REFERENCE TO RELATED APPLICATION

The present application is a U.S. National Stage Application of International Application No. PCT/US2014/065218 filed Nov. 12, 2014, which is incorporated herein by reference in its entirety for all purposes.

TECHNICAL FIELD

The present disclosure relates to wellbore completion operations and, more particularly, to a downhole completion assembly for sealing an inflow control device installed along a length of production tubing.

BACKGROUND

The advent of horizontal drilling has been considered a significant advance in the oil and gas industry. While this form of drilling has increased the complexity and cost of drilling, it has also increased economic returns to well operators. Horizontal drilling has lead to increased production because it maximizes the reservoir contact. This is because most oil and gas fields are generally horizontally situated. It has also enabled tapping reserves from zones previously thought too difficult to reach, such as thin oil zones.

Although horizontal completion technology and techniques have improved over the years, horizontal wells continue to face challenges. One of those challenges relates to uneven influx of reservoir fluid to the wellbore. This causes early water and gas breakthrough. Water and gas coning in the heel of the well is often blamed for these challenges. Another reason for water and gas breakthrough is related to uneven permeability and fractures or differences in fluid mobility, which occurs in wells with high-viscosity oil. Since it becomes easier for the reservoir fluid to be produced through one section compared to the other, having an even drawdown under conditions of uneven permeability or uneven fluid mobility can lead to premature breakthrough of water or gas.

In reservoirs which are largely homogenous with higher drawdown in the heel, one solution to the challenge of water and gas breakthrough is to balance the drawdown from the heel to the toe. This can be done by applying a controlled pressure drop from the annulus to the production tubing in the heel using inflow control devices (ICDs). The use of these devices reduces the drawdown and the fluid rate from this particular section. In reservoirs which are mostly heterogenous, where the drawdown is more equally distributed along the wellbore, the drawdown is reduced in high-permeability sections to allow low-productivity sections to flow more oil. This is typically achieved through equal distribution of the ICDs. ICDs have thus been very effective at delaying potential water or gas breakthroughs and thus allowing more oil to be produced throughout the life of the well.

There are some instances, however, where the balancing achieved using ICDs is insufficient to delay water and gas coning at the heel of a well. In those instances, it is desirable to close these zones at the heel while still allowing production from the deeper zones.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the invention.

The present disclosure provides a downhole completion system that features an expandable sealing structure and corresponding internal truss structure that are capable of being run through existing production tubing and subsequently expanded to support and seal the internal surface of an ICD so as to restrict the flow of fluids from the wellbore into the production tubing in the region where the ICD is installed. Once the sealing structure is run to its proper downhole location, which in most cases will be between the heel and toe of a horizontal section, it may be expanded by any number of expansion tools that are also small enough to axially traverse the production tubing. In operation, the expanded sealing structure may be useful in sealing the ICD thereby restricting the influx of unwanted fluids into the production tubing. The internal truss structure may be arranged within the sealing structure and useful in radially supporting the expanded sealing structure. In some embodiments, the sealing structure and corresponding internal truss structure are expanded at the same time with the same expansion tool.

The downhole completion system may provide advantages in that it is small enough to be able to be run-in through existing production tubing. When expanded, the disclosed downhole completion system may provide sufficient expansion within an ICD to adequately restrict the influx of undesired formation fluids, such as water and gas. As a result, the life of a well may be extended, thereby increasing profits and reducing expenditures associated with the well. As will be appreciated by those of ordinary skill in the art, the methods and systems disclosed herein may salvage or otherwise revive certain types of wells, which were previously thought be economically unviable.

Figure 1:
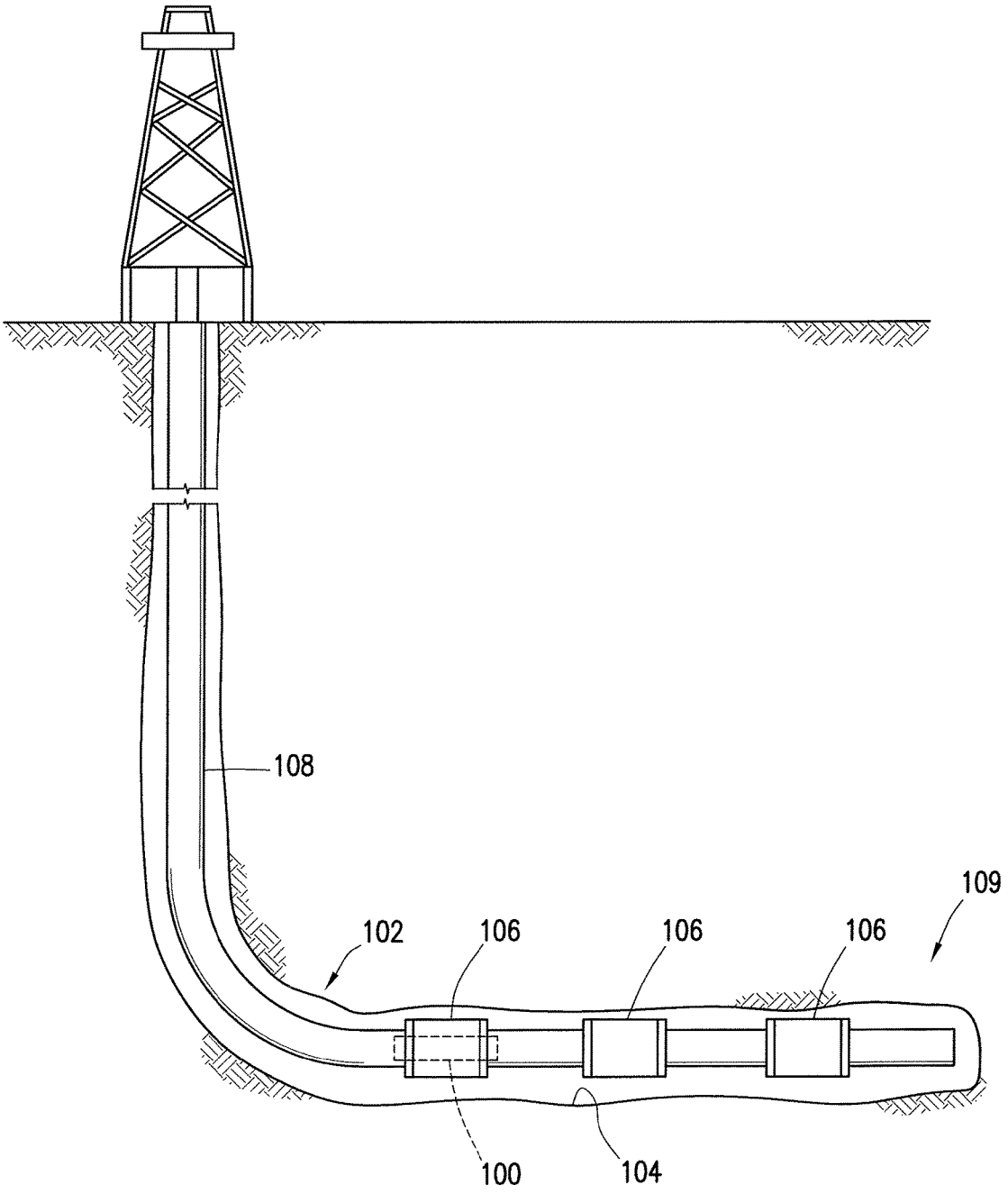
FIG. 1 illustrates a downhole completion system used to seal an inflow control device (ICD) completion, according to one or more embodiments.

Referring to FIG. 1, illustrated is an exemplary downhole completion system 100, according to one or more embodiments disclosed. As illustrated, the system 100 may be configured to be downstream from the heel portion 102 of horizontal wellbore 104 to seal an inflow control device (ICD) 106 installed along the tubing string 108. In other embodiments, an ICD may be installed along casing. As used herein, the term "casing" is intended to be understood broadly so as to casing and/or liners. Furthermore, as used, herein, the term or phrase "downhole completion system" should not be interpreted to refer solely to wellbore completion systems as classically defined or otherwise generally known in the art. Rather, the downhole completion system may also refer to, or be characterized as, a downhole fluid transport system.

While FIG. 1 depicts the system 100 as being arranged adjacent to the heel portion 102 of a horizontally-oriented wellbore 104, it will be appreciated that the system 100 may be equally arranged in a vertical or slanted portion of the wellbore 104, or any other angular configuration therebetween, without departing from the scope of the disclosure. Additionally, the system 100 may be arranged along other portions of the horizontal wellbore 104 in order to seal ICDs 106 located closer to the toe portion 109 of the horizontal wellbore 104.

In present embodiments, the system 100 includes a truss structure and a sealing structure disposed around the truss structure. The system 100 may be run in through the tubing string 108, past the heel portion 102 and is brought into alignment with the ICD 106 adjacent to the heel portion 102. From this position, as described in detail below, an expansion tool may be actuated to expand the truss structure and the sealing structure of the system 100 against an inner portion of the ICD 106, thereby sealing the ICD 106.

Figure 2A:
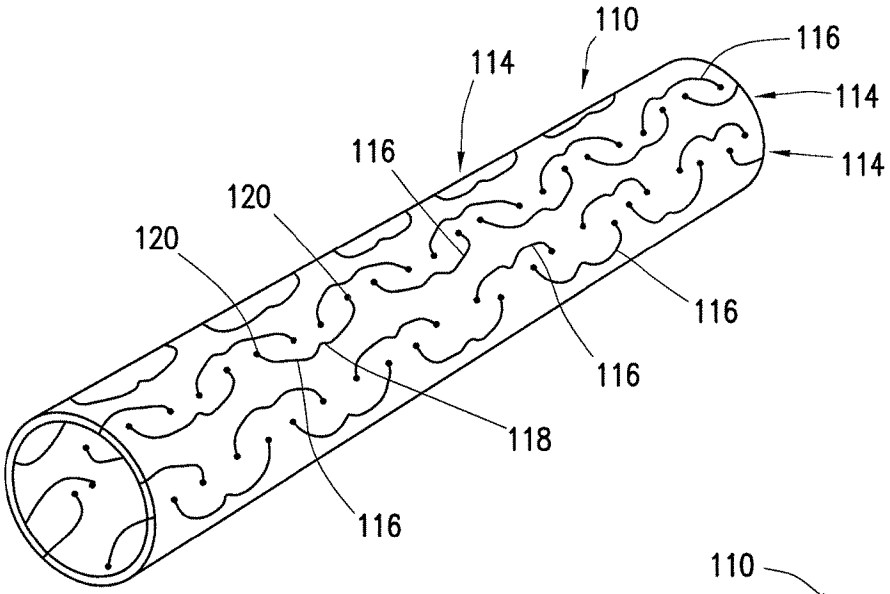
FIGS. 2A and 2B illustrate contracted and expanded sections of a truss structure, respectively, according to one or more embodiments.
Figure 2B:
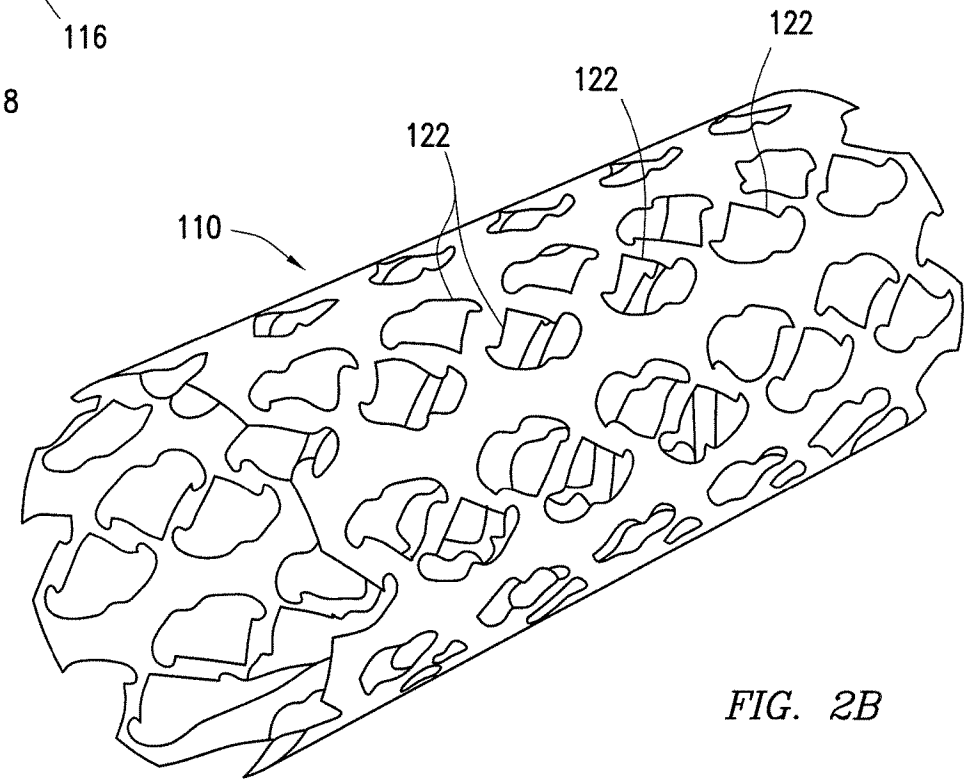
Figure 3A:
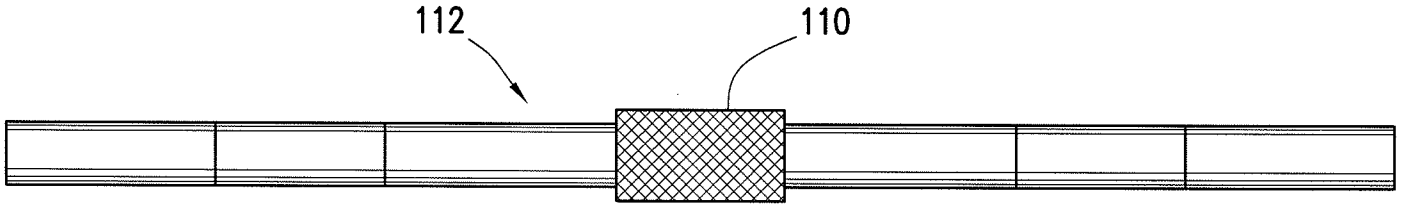
FIGS. 3A and 3B illustrate a truss structure disposed on an expansion tool in contracted and expanded configurations, respectively, according to one or more embodiments.
Figure 3B:
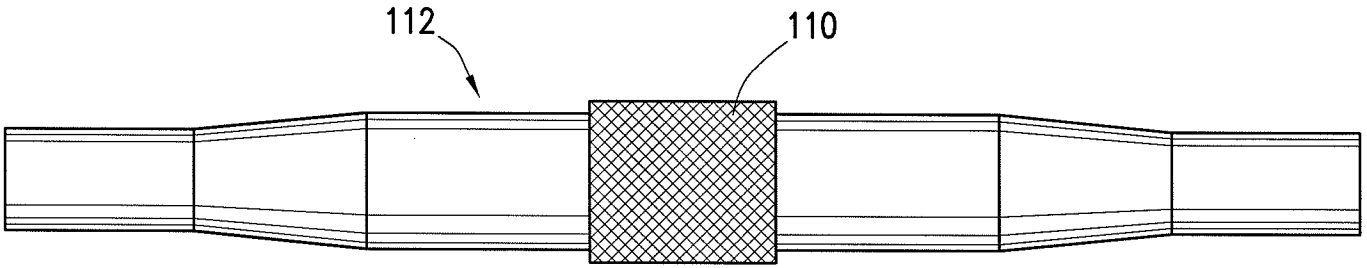

Having generally described the context in which the disclosed downhole completion system 100 may be utilized, a more detailed description of the components that make up the system 100 will be provided. To that end, FIGS. 2A and 2B illustrate the truss structure 110 of the system 100. In one embodiment, the truss structure 110 is formed of a stainless steel tube, which has a pattern cut into it that enables it to expand in diameter more than 50% and up to approximately 300% without changing axial length, while at the same time maintaining a useful strength. It should be noted that any suitable expansion range is contemplated for the expanded diameter of the tube without changing its axial length. The tube serves as the support structure upon which a separate sealing layer is added. In some embodiments, a feature of the pattern is that it enables the tube to expand radially into a trussed shape that is internal to the outer sealing layer. The term "trussed shape" refers to the expanded pattern of the tube having open spaces outlined by interconnected portions of the tube (e.g., trusses). These trusses may provide additional strength and sealing capabilities. The sealing element/tube assembly may be expanded in a number of different ways (e.g., a cone, downhole power unit, etc.), but one embodiment is expansion via a hydraulic inflation tool 112, such as an inflatable packer, which is shown generally in FIGS. 3A and 3B. FIG. 3A illustrates the truss structure 110 in its collapsed/contracted configuration disposed on a hydraulic inflation tool 112. FIG. 3B illustrates the truss structure 110 in its expanded configuration upon activation of the hydraulic inflation tool 112. In one embodiment, the truss structure 110 is formed of a sheet metal having memory characteristics.

In certain embodiments, the truss structure 110 is formed by cutting the desired pattern into a 2.5 to 3 inch diameter, 30 inch long, schedule 40/80 stainless steel pipe. As those of ordinary skill in the art will appreciate, the size and composition of the truss structure 110 is not limited to this exemplary embodiment. Further, it will be appreciated that the truss structure 110 may be formed using any suitable manufacturing technique including, but not limited to, casting, 3D printing, etc. In the illustrated embodiment, the cut pattern is formed of a plurality of rows 114 of perforations disposed equidistant around the circumference of the truss structure 110. These perforations may form a plurality of expandable cells 122 defined on the truss structure 110. Each row 114 is formed of a plurality of generally opposing, longitudinally offset arc-shaped perforations 116, each having a dimple 118 formed in the approximate mid-section of the arc, as shown in FIG. 2A. The arc-shaped perforations 116 are arranged along the length of the truss structure 110 and have holes 120 formed at the beginning and end of each arc. The holes 120 and the arcs 116 may completely penetrate the steel structure of pipe. In other embodiments, the arcs 116 themselves may only partially penetrate through the pipe wall. In still further embodiments, neither the arcs 116 nor the holes 120 may penetrate through the pipe wall. The pattern is preferably cut using a water jet, but may also be cut using a laser.

Each of the expandable cells 122 includes a perimeter that is defined by the arc-shaped perforations 116, the dimples 118, and the holes 120. Upon expansion of the cells 122, the arc-shaped perforations open up and form opposing offset generally pie-shaped openings in the body of the truss structure 110, which are formed along the length of the pipe, as shown in FIG. 2B. It should be apparent that other embodiments may be utilized, such as where the truss structure 110 uses linear rather than arc-shaped perforations 116. In other embodiments, the perforations 116 are not generally opposing.

It should be noted that any suitable shaped perforations 116 that permit the truss structure 110 to expand may be used in other embodiments. In addition, any suitable number of such perforations 116 may be utilized to provide the desired expansion. Furthermore, any suitable relationship between the perforations 116 may be contemplated in the disclosed embodiments. Still further, the openings 122 in the body of the truss structure 110 may have any suitable shaped upon expansion of the truss structure 110.

Figure 4:
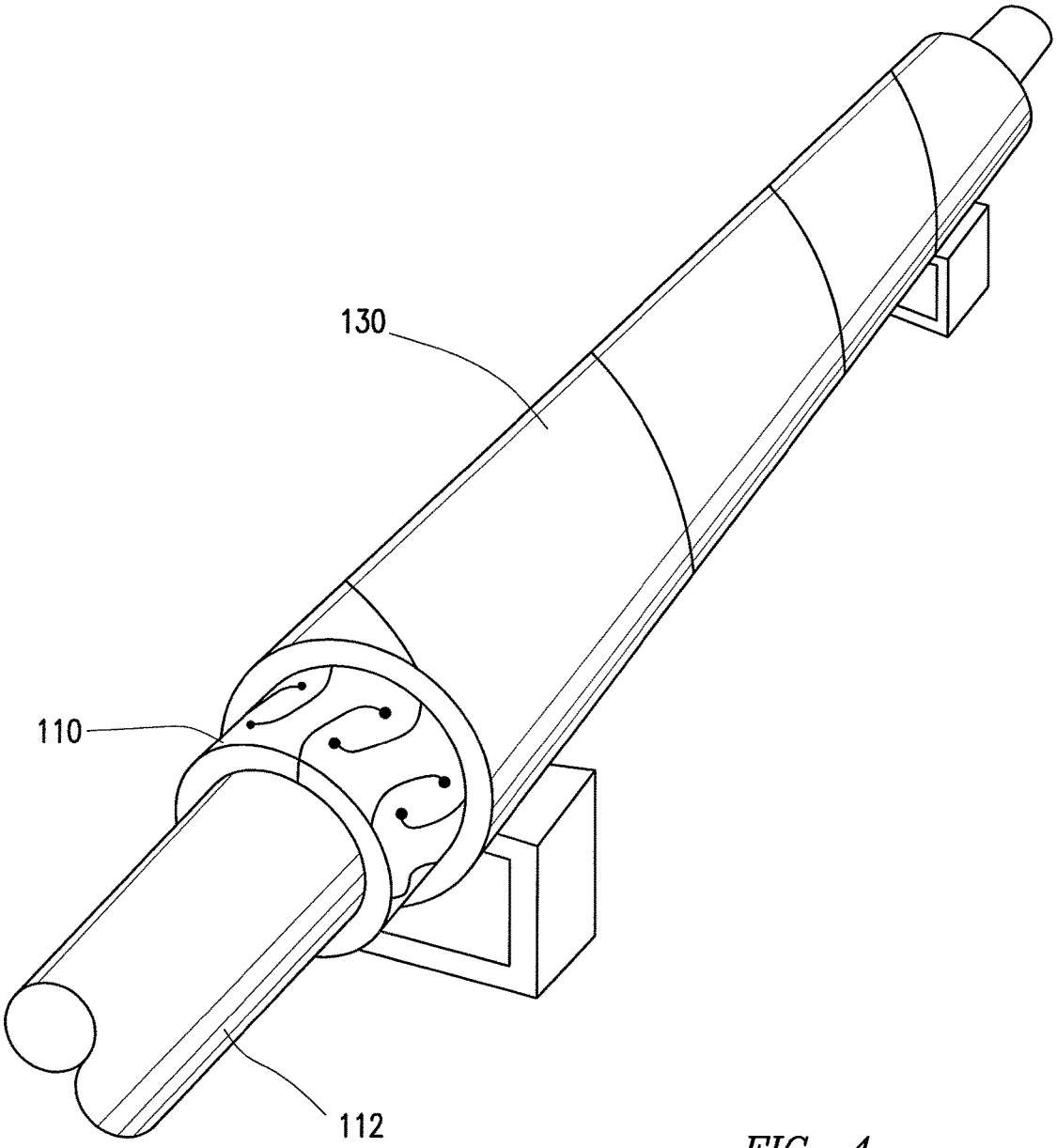
FIG. 4 illustrates a sealing structure layered on a truss structure, with an expansion tool inserted inside of the truss structure with the truss and sealing structures in retracted configurations, according to one or more embodiments.

The run-in configuration of the downhole completion system 100 is shown in FIG. 4, with a sealing structure 130 disposed on the truss structure 110. The sealing structure 130 is an elongate tubular member. In some embodiments, the sealing structure 130 may be formed by coiling a sealable material around the truss structure 110. The sealing material may be formed of rubber; thermoset plastics; thermoplastics; fiber-reinforced composites; cementious compositions; corrugated, crenulated, circular, looped or spiral metal or metal alloy; any combinations of the forgoing; or any other suitable sealing material. As illustrated, the truss structure 110 may be nested inside the sealing structure 130 when the sealing structure 130 is in its contracted configuration. In some embodiments, multiple truss structures 110 may be nested to create a longer length.

Figure 5:
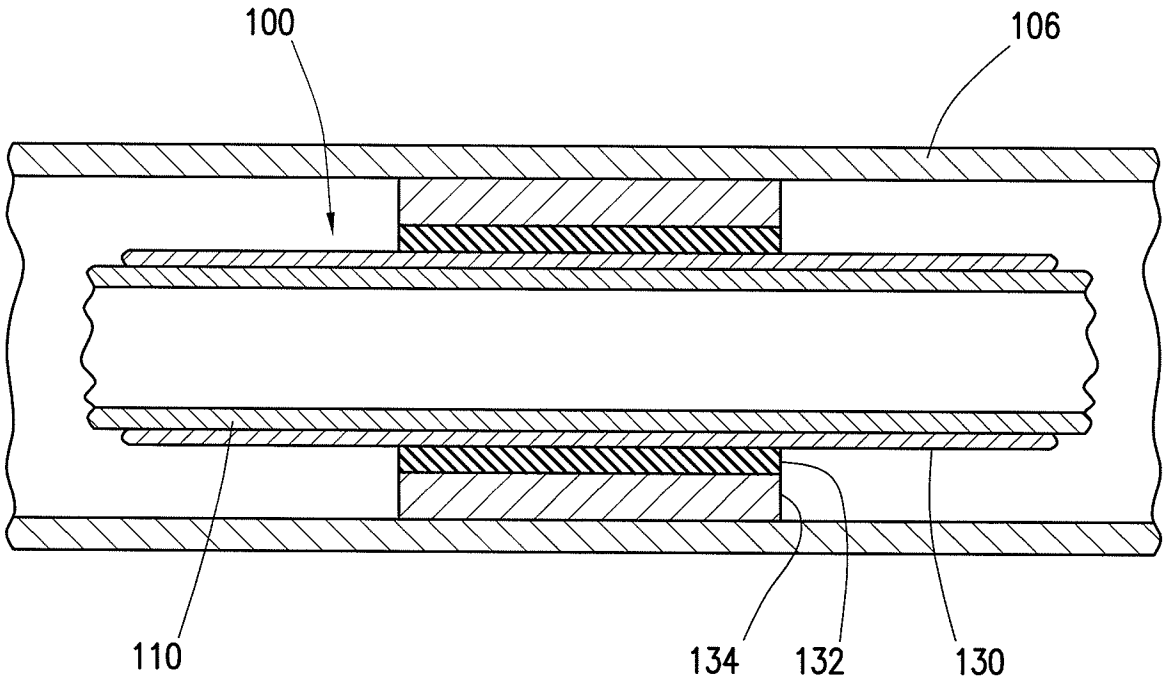
FIG. 5 is a cross-sectional view of truss and sealing structures in expanded configurations showing the sealing structure in engagement with an ICD completion.

In some embodiments, the sealing structure 130 may further include a sealing element 132 disposed about at least a portion of the outer circumferential surface of the sealing structure, as illustrated in FIG. 5. In some embodiments, an additional layer of protective material 134 may surround the outer surface of the sealing element 132 to protect the sealing element 132 as it is advanced through the wellbore. The protective material 134 may further provide external support to the sealing structure 130. For example, the protective material 134 may provide external support to the sealing structure 130 (and truss structure) by holding the sealing structure 130 under a maximum running diameter prior to the placement and expansion of the truss structure within the tubing string 108. The term "maximum running diameter" refers to a diameter that the sealing structure 130 is not exceed while the downhole completion system 100 is being run through tubing in the wellbore. Indeed, the protective material 134 may exert a slight compressive force on the sealing structure 130 (and the truss structure) to maintain these structures in a compressed position while the system is lowered through the wellbore. After reaching the appropriate position in the wellbore, an inflation tool, as described above, may exert a force on the inside surface of the truss structure that opposes and overcomes the compressive force from the protective material 134 in order to expand the completion system 100.

In operation, the sealing element 132 may be configured to expand as the sealing structure 130 expands and ultimately engage and seal against the inner diameter of the ICD 106. In some embodiments, the sealing element 132 may be arranged at two or more discrete locations along the length of the sealing structure 130. In some embodiments, the sealing element 132 may be arranged at a location along the length of the sealing structure 130 that corresponds with the location of apertures in the ICD 106, through which production fluids would otherwise enter the tubing string 108. The sealing element 132 may be made of an elastomer, a rubber, or any other suitable material. The sealing element 132 may further be formed from a swellable or non-swellable material. In at least one embodiment, the sealing element 132 may be a swellable elastomer that swells in the presence of at least one of water and oil. However, it will be appreciated that any suitable swellable material may be employed and remain within the scope of the present disclosure.

In other embodiments, the material for the sealing elements 132 may vary along the sealing section in order to create the best sealing available for the fluid type that the particular seal element may be exposed to. For instance, one or more bands of sealing materials may be located as desired along the length of the sealing section. The material used for the sealing element 132 may include swellable elastomeric, as described above, and/or bands of viscous fluid. The viscous fluid, for instance, may be an uncured elastomeric that will cure in the presence of well fluids. The viscous fluid may include a silicone that cures with water in some embodiments. In other embodiments, the viscous fluid may include other materials that are a combination of properties, such as a viscous slurry of the silicone and small beads of ceramic or cured elastomeric material. The viscous material may be configured to better conform to the annular space between the expanded sealing structure and the varying shape of the tubing string 108 and/or the ICD 106. It should be noted that to establish a seal, the material of the sealing element 132 does not need to change properties, but only have sufficient viscosity and length to remain in place the life of the well. The presence of other fillers, such as fibers, may enhance the viscous material.

Figure 6:
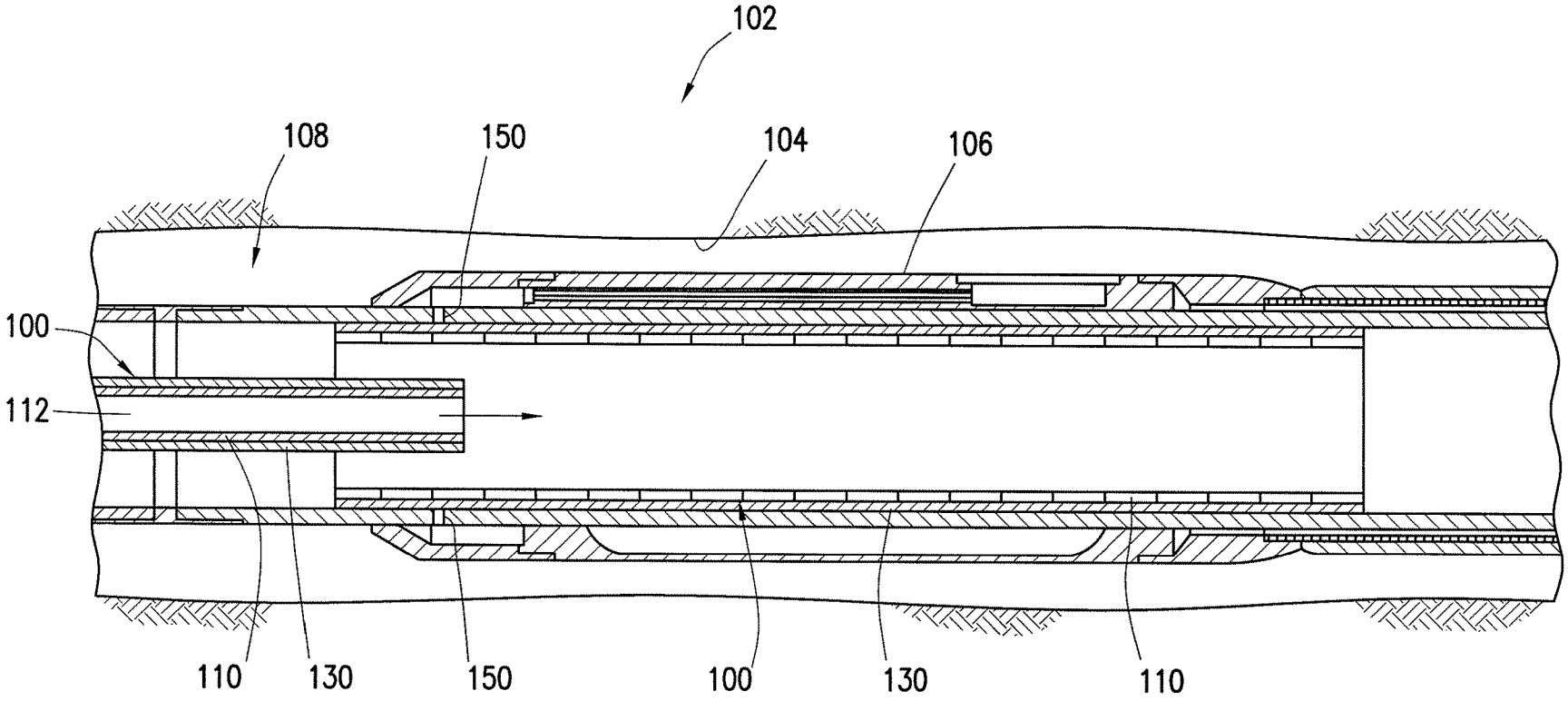
FIG. 6 is a cross-sectional view of truss and sealing structures in expanded configurations showing the downhole completion system in engagement with an ICD completion.

As illustrated, and as will be discussed in greater detail below, at least one truss structure 110 may be generally arranged within a corresponding sealing structure 130 and may be configured to radially expand to seal a portion of production tubing. For example, FIG. 6 illustrates a cross-section of an ICD completion (as described above with reference to FIG. 1) being sealed by the downhole completion system 100 described above. As illustrated, the ICD 106 includes various ports 150 through which production fluid would normally flow from the subterranean formation into the tubing string 108 with a calibrated pressure drop. In the downhole completion system 100, the expanded truss structure 110 holds the sealing structure 130 against these apertures 150, thereby sealing the ICD 106 so that water or gas does not flow into the tubing string 108. As illustrated, there is no expansion tool present within the system 100, since the expansion tool may function as a deployment device that is removable after being used to expand the system 100 into sealing engagement with the ICD 106.

During installation, the system 100 may be combined with a mechanical connection to the surface for translating the system 100 through the tubing string 108. The mechanical connection may include a conveyance device used to transport the sealing structure 130 and truss structure 110 in their respective contracted configurations through the tubing string 108 to the ICD 106. The conveyance device may include a wireline, a slickline, coiled tubing or jointed tubing. In some embodiments, the system 100 may be run in to the ICD 106 in a contracted state on an expansion tool coupled to the mechanical connection prior to expansion via the expansion tool. After expansion of the system 100, the expansion tool may be released and translated out of the tubing string 108 via the mechanical connection. In some embodiments, the system 100 may be positioned within the ICD 106 to seal the ports 150 through the use of a spinner, a casing-collar locator, tagging off of a known restriction (e.g., landing nipple), or any other method. In some embodiments, the system 100 and/or the ICD 106 may be equipped with a sensor for determining the position of the system 100 with respect to the ICD 106 and the ports 150 that need to be covered.

In some embodiments, multiple different ICDs 106 located along the horizontal wellbore 104 may need to be sealed throughout the life of the well. For example, the ICD 106 located adjacent to the heel portion 102 of the horizontal wellbore 104 may be sealed first and then another ICD 106 located closer to the toe of the horizontal wellbore 104 may need to be sealed to prevent water encroachment. In such situations, an additional downhole completion system 100 may be deployed into the horizontal wellbore 104 to seal the other ICD 106. As illustrated, the additional system 100 may be translated (in a contracted configuration) through the expanded system 100 that is already sealing the ICD 106 near the heel portion 102. This is because an inner diameter of the truss structure 110 in the expanded configuration is greater than an outer diameter of the downhole completion system 100 in the contracted configuration. Thus, sealing can be provided along the ICDs 106 from heel to toe within the horizontal wellbore 104.

The disclosed downhole completion system 100 may be deployed directly into the tubing string 108 to seal ICDs 106 at any point along the length of the horizontal wellbore 104 and at any point during production. This allows flexibility in sealing off various ICDs 106 in order to increase the amount of formation fluids produced through the horizontal wellbore 104. An operator does not have to anticipate which zones of the horizontal wellbore 104 might start taking in water or gas during the lifetime of the well. In addition, the use of the system 100 to seal the ICD 106 near the heel portion 102 of the wellbore does not prevent the installation of another system 100 further along the horizontal wellbore 104.

Embodiments disclosed herein include:

A. A method of sealing an inflow control device installed in a subterranean formation which is producing an undesirable fluid that includes conveying a truss structure and sealing structure disposed thereon into production tubing adjacent the inflow control device. The truss and sealing structures being radially expandable between a contracted configuration and an expanded configuration. The method also includes radially expanding the truss and sealing structures from their contracted configurations to an expanded configuration whereby the sealing structure seals against the inflow control device thereby creating a flow restriction between the subterranean formation and an inside surface of the production tubing.

B. A downhole completion system includes a truss structure and a sealing structure disposed about the truss structure. The truss structure is radially expandable between a contracted configuration and an expanded configuration. The sealing structure is radially expandable between a contracted configuration and an expanded configuration. The sealing structure is operable to seal one or more apertures in an inflow control device so as to restrict the flow of fluids through the apertures.

Each of the embodiments A and B may have one or more of the following additional elements in combination: Element 1: wherein when in the expanded configuration the truss structure radially supports the sealing structure. Element 2: further including conveying the sealing and truss structures into the production tubing simultaneously, the truss structure being nested inside the sealing structure when the sealing structure is in its contracted configuration. Element 3: wherein radially expanding the truss structure into its expanded configuration further comprises expanding a plurality of expandable cells defined on the truss structure. Element 4: wherein the axial length of the truss structure in the contracted and expanded configurations is substantially the same. Element 5: wherein a diameter of the truss structure is expanded by more than 50% when the truss structure is expanded from the contracted configuration to the expanded configuration. Element 6: further including conveying the truss structure and the sealing structure into the production tubing until the truss structure and the sealing structure are disposed in proximity to the inflow control device based on sensor feedback, and radially expanding the truss and sealing structures from their contracted configurations to the expanded configuration when the truss and sealing structures are disposed in proximity to the inflow control device. Element 7: further including conveying a second truss structure with a second sealing structure disposed thereon in a contracted configuration into the production tubing and through the expanded truss structure.

Element 8: further including a conveyance device to transport the sealing and truss structures in their respective contracted configurations through the production tubing to the inflow control device. Element 9: wherein the conveyance device is selected from the group consisting of wireline, slickline, coiled tubing and jointed tubing. Element 10: further including a deployment device to radially expand the sealing and truss structures from their respective contracted configurations to their respective expanded configurations, the truss structure being expanded while arranged at least partially within the sealing structure. Element 11: wherein the deployment device is selected from the group consisting of a hydraulic inflation tool and an inflatable packer. Element 12: wherein when in the expanded configuration the truss structure radially supports the sealing structure. Element 13: wherein the truss structure includes a plurality of expandable cells. Element 14: wherein at least one of the plurality of expandable cells includes an arc-shaped perforation with holes formed at the beginning and end of the arc-shaped perforation. Element 15: wherein the truss structure has a diameter which expands by more than 50% when the truss structure is expanded from the contracted configuration to the expanded configuration. Element 16: wherein the axial length of the truss structure in the contracted and expanded configurations is substantially the same. Element 17: wherein an inner diameter of the truss structure in the expanded position is greater than an outer diameter of the sealing structure in the contracted position. Element 18: wherein a swellable material is disposed about at least a portion of the truss structure.

Although the present disclosure and its advantages have been described in detail, it should be understood that various changes, substitutions and alterations can be made herein without departing from the spirit and scope of the disclosure as defined by the following claims.

What is claimed is:

1. A method of sealing an inflow control device installed in a subterranean formation which is producing an undesirable fluid, said method comprising:

(a) conveying a truss structure and sealing structure disposed thereon through production tubing adjacent the inflow control device, said truss and sealing structures being radially expandable between a contracted configuration and an expanded configuration, wherein the inflow control device comprises:

an inner tubular defining a flowbore and coupled to the production tubing;

an outer housing disposed around the inner tubular and having at least one opening therein to allow fluid flow from the subterranean formation into an annulus between the outer housing and the inner tubular; and at least one aperture extending through the inner tubular to fluidly connect the annulus between the outer housing and the inner tubular to the flowbore; and (b) radially expanding the truss and sealing structures from their contracted configurations to an expanded configuration whereby the sealing structure seals against the at least one aperture of the inflow control device thereby creating a flow restriction between the subterranean formation and an inside surface of the production tubing.

2. The method of claim 1, wherein when in the expanded configuration the truss structure radially supports the sealing structure.

3. The method of claim 1, further comprising conveying the sealing and truss structures through the production tubing simultaneously, the truss structure being nested inside the sealing structure when the sealing structure is in its contracted configuration.

4. The method of claim 1, wherein radially expanding the truss structure into its expanded configuration further comprises expanding a plurality of expandable cells defined on the truss structure.

5. The method of claim 1, further comprising conveying the truss structure and the sealing structure through the production tubing until the truss structure and the sealing structure are disposed in proximity to the inflow control device as determined based on sensor feedback, and radially expanding the truss and sealing structures from their contracted configurations to the expanded configuration when the truss and sealing structures are disposed in proximity to the inflow control device.

6. The method of claim 1, further comprising conveying a second truss structure with a second sealing structure disposed thereon in a contracted configuration through the production tubing and through the expanded truss structure.

7. A downhole completion system, comprising:

(a) a truss structure, the truss structure being radially expandable between a contracted configuration and an expanded configuration; and (b) a sealing structure disposed about the truss structure, the sealing structure being radially expandable between a contracted configuration and an expanded configuration, said sealing structure being operable to seal an inflow control device comprising:

an inner tubular defining a flowbore and coupled to production tubing;

an outer housing disposed around the inner tubular and having at least one opening therein to allow fluid flow from the subterranean formation into an annulus between the outer housing and the inner tubular; and at least one aperture extending through the inner tubular to fluidly connect the annulus between the outer housing and the inner tubular to the flowbore;

wherein the sealing structure is operable to seal the at least one aperture of the inflow control device so as to restrict the flow of fluids through the at least one aperture.

8. The downhole completion system according to claim 7, further comprising a conveyance device to transport the sealing and truss structures in their respective contracted configurations through the production tubing to the inflow control device, wherein the conveyance device is selected from the group consisting of wireline, slickline, coiled tubing, and jointed tubing.

9. The downhole completion system according to claim 7, further comprising a deployment device to radially expand the sealing and truss structures from their respective contracted configurations to their respective expanded configurations, the truss structure being expanded while arranged at least partially within the sealing structure.

10. The downhole completion system according to claim 9, wherein the deployment device is selected from the group consisting of a hydraulic inflation tool and an inflatable packer.

11. The downhole completion system according to claim 7, wherein the truss structure includes a plurality of expandable cells.

12. The downhole completion system according to claim 11, wherein at least one of the plurality of expandable cells includes an arc-shaped perforation with holes formed at the beginning and end of the arc-shaped perforation.

13. The downhole completion system according to claim 7, wherein the truss structure has a diameter which expands by more than 50% when the truss structure is expanded from the contracted configuration to the expanded configuration.

14. The downhole completion system according to claim 7, wherein the axial length of the truss structure in the contracted and expanded configurations is substantially the same.

15. The downhole completion system according to claim 7, wherein an inner diameter of the truss structure in the expanded position is greater than an outer diameter of the sealing structure in the contracted position.

16. The downhole completion system according to claim 7, wherein a swellable material is disposed about at least a portion of the truss structure.

17. The downhole completion system according to claim 7, further comprising the inflow control device.

18. The method of claim 6, further comprising:

conveying the second truss structure and sealing structure disposed thereon through the production tubing to a position proximate a second inflow control device located downhole from the inflow control device, wherein the second inflow control device comprises:

an inner tubular defining a flowbore and coupled to the production tubing;

an outer housing disposed around the inner tubular and having at least one opening therein to allow fluid flow from the subterranean formation into an annulus between the outer housing and the inner tubular; and at least one aperture extending through the inner tubular to fluidly connect the annulus between the outer housing and the inner tubular to the flowbore; and radially expanding the second truss and sealing structures from their contracted configurations to an expanded configuration whereby the second sealing structure seals against the at least one aperture of the second inflow control device.

19. The method of claim 1, further comprising exerting a compressive force on the sealing structure and the truss structure via a protective material surrounding an outer surface of the sealing element as the truss and sealing structures are lowered through the production tubing.

20. The downhole completion system according to claim 16, wherein the swellable material comprises one or more bands of viscous fluid.

* * * * *